US009842520B2

(12) United States Patent
Howard

(10) Patent No.: US 9,842,520 B2
(45) Date of Patent: Dec. 12, 2017

(54) PRODUCT DISPLAY MEMBERS

(71) Applicant: Display Technologies, LLC, Lake Success, NY (US)

(72) Inventor: Andrew Howard, Larchmont, NY (US)

(73) Assignee: Display Technologies LLC, Lake Success, NY (US)

( * ) Notice: Subject to any disclaimer, the term of this patent is extended or adjusted under 35 U.S.C. 154(b) by 192 days.

(21) Appl. No.: 14/875,958

(22) Filed: Oct. 6, 2015

(65) Prior Publication Data

US 2016/0097516 A1 Apr. 7, 2016

Related U.S. Application Data

(60) Provisional application No. 62/060,356, filed on Oct. 6, 2014.

(51) Int. Cl.

| | |
|---|---|
| ***G09F 3/20*** | (2006.01) |
| ***G09F 13/04*** | (2006.01) |
| ***G09F 23/06*** | (2006.01) |
| ***A47F 3/00*** | (2006.01) |
| ***A47F 5/00*** | (2006.01) |
| ***A47F 11/10*** | (2006.01) |

(52) U.S. Cl.

CPC ..... *G09F 3/204* (2013.01); *A47F 3/001* (2013.01); *A47F 5/0068* (2013.01); *A47F 11/10* (2013.01); *G09F 13/04* (2013.01); *G09F 23/06* (2013.01)

(58) Field of Classification Search

CPC ..... G09F 3/204; G09F 13/04; G09F 23/06; A47F 11/10; A47F 3/001; A47F 5/0068

See application file for complete search history.

(56) References Cited

U.S. PATENT DOCUMENTS

| | | | | |
|---|---|---|---|---|
| 7,513,637 | B2 * | 4/2009 | Kelly | A47F 3/001 362/125 |
| 2005/0082450 | A1 | 4/2005 | Barrett et al. | |
| 2014/0254136 | A1 | 9/2014 | Oraw et al. | |

OTHER PUBLICATIONS

International Search Report dated Feb. 5, 2015 in corresponding PCT Application No. PCT/US15/54163.

* cited by examiner

*Primary Examiner* — David V Bruce

(74) *Attorney, Agent, or Firm* — Carter, DeLuca, Farrell & Schmidt, LLP

(57) ABSTRACT

A product display member is disclosed. The product display member includes an attachment portion, an elongated portion, a light source, and an information display portion. The attachment portion is configured to engage a portion of a shelf. The elongated portion is disposed in mechanical cooperation with the attachment portion. The elongated portion defines a lumen extending at least partially therethrough. The light source is disposed in mechanical cooperation with the lumen. The information display portion is disposed in mechanical cooperation with the elongated portion.

19 Claims, 3 Drawing Sheets

PRODUCT DISPLAY MEMBERS

CROSS-REFERENCE TO RELATED APPLICATIONS

The present application claims the benefit of and priority to U.S. Provisional Patent Application Ser. No. 62/060,356 filed on Oct. 6, 2014, the entire contents of which being herein incorporated by reference in its entirety.

BACKGROUND

The present disclosure relates to product display members that are configured for attachment to store shelving. More particularly, the present disclosure relates to product display members that are attachable to a proximal or front portion of a store shelf (e.g., a wire shelf) and include a light associated therewith to help illuminate products displayed on the shelf and/or product information.

SUMMARY

The present disclosure relates to a product display member. The product display member includes an attachment portion, an elongated portion, a light source, and an information display portion. The attachment portion is configured to engage a portion of a shelf. The elongated portion is disposed in mechanical cooperation with the attachment portion. The elongated portion defines a lumen extending at least partially therethrough. The light source is disposed in mechanical cooperation with the lumen. The information display portion is disposed in mechanical cooperation with the elongated portion.

In disclosed embodiments, at least part of the elongated portion allows light emitted from the light source to pass therethrough. It is further disclosed that at least part of the information display portion allows light emitted from the light source to pass therethrough. Additionally, it is disclosed that a distal back surface of the information display portion allows light emitted from the light source to pass therethrough.

In embodiments of the product display member, a base of the product display member defines an angle with respect to the information display portion. The angle may be between about 45° and about 90°.

In disclosed embodiments, the lumen extends along an entire length of the elongated portion. It is further disclosed that the light source may be removably disposed within the lumen.

It is disclosed that the attachment portion includes an upper arcuate portion and a lower arcuate portion. In embodiments, the upper arcuate portion is configured to engage an upper wire of the shelf, and the lower arcuate portion is configured to engage a lower wire of the shelf.

The present disclosure also relates to a method of displaying products. The method includes engaging a product display member with a portion of a shelf. The product display member includes an attachment portion, an elongated portion, a light source, and an information display portion. The attachment portion is configured to engage a portion of a shelf. The elongated portion is disposed in mechanical cooperation with the attachment portion. The elongated portion defines a lumen extending at least partially therethrough. The light source is disposed in mechanical cooperation with the lumen. The information display portion is disposed in mechanical cooperation with the elongated portion. The method also includes illuminating at least one of the information display portion and a product on the shelf with light emitted from the light source.

In disclosed embodiments, the method includes adjusting an output of the light source based on a parameter detected by an associated sensor. It is further disclosed that the method includes automatically adjusting an output of the light source based on a time parameter from a controller. Further, disclosed methods include automatically adjusting an output of the light source in response to a sensor detecting an object in proximity to the product display member. The sensor and an associated controller are located on the product display member.

In disclosed embodiments, the method includes emitting light from the light source through the elongated portion. It is further disclosed that the method includes emitting light from the light source through the information display portion. Further, disclosed methods include emitting light from the light source through a distal back surface of the information display portion.

It is further disclosed that engaging a portion of the product display member with a portion of the shelf includes engaging an upper arcuate portion of the attachment portion with an upper wire of the shelf, and engaging a lower arcuate portion of the attachment portion with a lower wire of the shelf.

BRIEF DESCRIPTION OF DRAWINGS

Embodiments of the present disclosure are described hereinbelow with reference to the drawings wherein.

DETAILED DESCRIPTION

Figure 1:
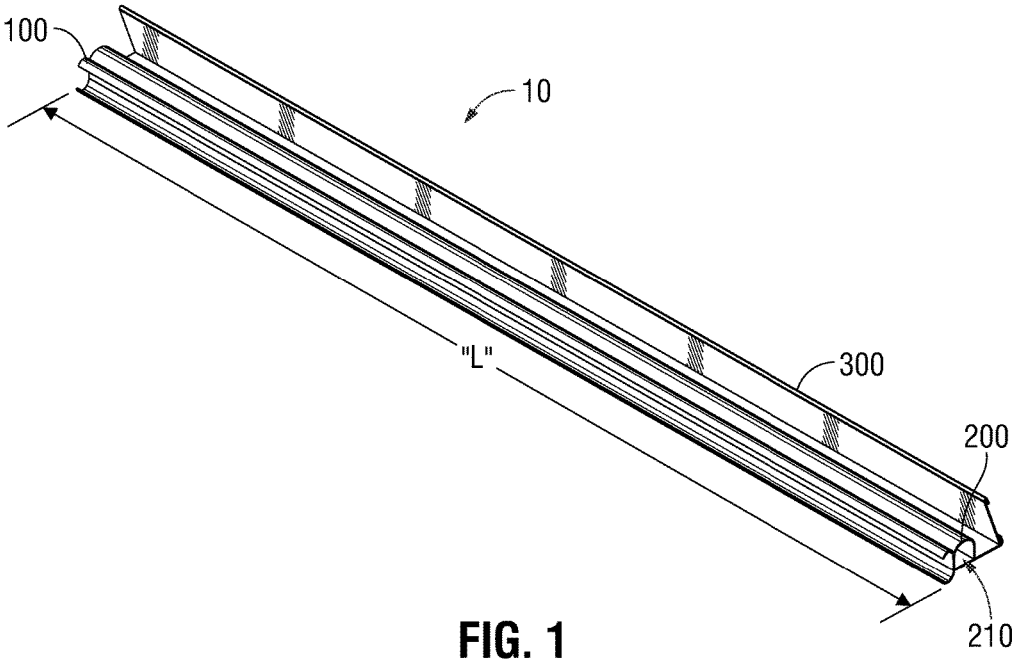
FIG. 1 is a perspective view of a product display member according to the present disclosure.
Figure 2:
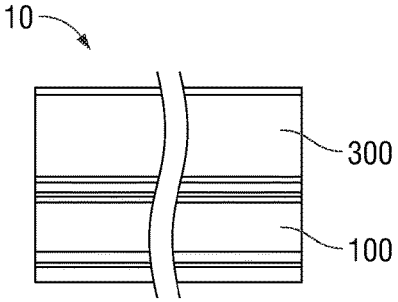
FIG. 2 is a rear, proximally-facing view the product display member of FIG. 1.

Embodiments of the presently disclosed product display member are described in detail with reference to the drawings wherein like numerals designate identical or corresponding elements in each of the several views. In the descriptions that follow, the term "proximal," as is traditional, will refer to the portion of the product display member and/or shelves which is closer to the user (e.g., consumer), while the term "distal" will refer to the portion or portions which are farther from the user.

With reference to the accompanying figures, product display member 10 is illustrated in FIGS. 1-6. Product display member 10 includes an attachment portion 100, an elongated portion 200 defining a channel or lumen 210, and an information display portion 300.

Figure 6:
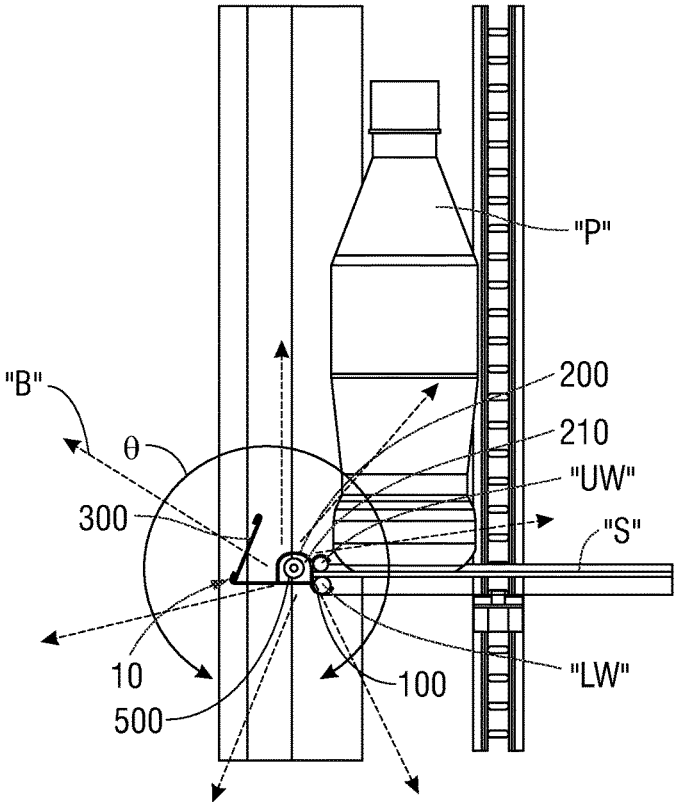
FIG. 6 is a side view of the product display member of FIGS. 1-5 engaged with a shelf having a product thereon.

Attachment portion 100 is configured for engagement with a proximal portion of a shelf "S" (see FIG. 6). For instance, attachment portion 100 may be sufficiently flexible such that product display member 10 can releasably engage shelf "S." Additionally, attachment portion 100 may be configured to slidingly engage shelf "S." In the illustrated embodiments, attachment portion 100 includes an upper arcuate portion 110 and a lower arcuate portion 120. It is envisioned that upper arcuate portion 110 is configured to engage an upper wire "UW" of a shelf "S," and that lower arcuate portion 120 is configured to engage a lower wire "LW" (see FIG. 6). It is envisioned that attachment portion 100 can be configured to engage (e.g., removably engage) any one of a various number of types of shelves. It is further envisioned that upper arcuate portion 110 and/or lower arcuate portion 120 are sufficiently flexible with respect to elongated portion 200 and with respect to each other to allow attachment portion 100 to be attached to and to be removed from shelf "S."

Lumen 210 is defined at least partially within elongated portion 200 and is configured to house a light source 500. Light source 500 may be a single light bulb or a plurality of light bulbs. Lumen 210 may extend the entire length "L" or a portion of the length "L" of elongated portion 200. Further, light source 500 may extend the entire length "L" or a portion of the length "L" of elongated portion 200 and/or of lumen 210. Alternatively, multiple light sources 500 may be disposed within lumen 210. It is envisioned that in instances where multiple light sources 500 are employed, one light source may produce an output of a first color and a second light source produce an output of a second, different color. Additional light sources may complement these with additional colors and/or color temperatures. It is further contemplated that when multiple light sources 500 are employed, that the light sources may be of differing types (e.g., fluorescent and incandescent, fluorescent and LED, etc.) The present disclosure also envisions the length "L" of elongated portion 200 and/or the length of the entirety or other portions of product display member 10 being adjustable (e.g., telescopically). Further, at least part of elongated portion 200 may be transparent or translucent to allow light emitted from light source 500 to pass therethrough. For instance, any portion of the length "L" or elongated portion, and any portion of the cross-section of elongated portion 210 may be transparent or translucent. In embodiments, the entirety of elongated portion 200 is transparent or translucent.

Additionally, lumen 210 may include any shape or cross-section, and is thus not limited to the embodiment shown. For example, the cross-section of lumen 210 may be or include a rectangular portion, a square portion, a circular portion, a semi-circular portion, a triangular portion, etc. or any combination thereof. For example, the cross-section of lumen 210 may be rectangular within one, two, three or four arcuate sides.

Light source 500 may include one or more light-emitting diodes ("LEDs"), incandescent bulbs, fluorescent bulbs, etc. and may be battery-powered or electrically connected to a source of electricity. Further, light source 500 may include a light-bar, a series of individual lights, tape lights, strip lights, ribbon lights, or the like, and may provide illumination in any color or series of colors. Moreover, light source 500 may be integrally-formed with product display member 10, or light source 500 may be insertable into and/or removable from lumen 210 (e.g., to replace light source 500 and/or a battery or bulb therein). It is envisioned that light source 500 provides illumination in the form of light beams "B" in any number of degrees θ. For instance, with reference to FIG. 6, it is envisioned that light source 500 provides illumination in an area of between about 180° and about 360°. It is further envisioned that light source 500 provides illumination in an area of between about 280° and about 320°, or equal to about 300°.

As shown in FIG. 6, light source 500 is configured to illuminate at least one product "P" displayed on shelf "S," and/or information display portion 300. It is envisioned that all or part (e.g., information display portion 300) of product display member 10 is made from a translucent and/or transparent material (e.g., plastic) to enable at least part of the light beams "B" emitted from light source 500 to pass therethrough. In embodiments where information display portion 300 is made from a transparent or translucent material, the information displayed therein or thereon is back-lit through a distal back surface 315 (see FIG. 3; i.e., illuminated from behind). It is further envisioned that the distal back surface 315 of information display portion 300 could be made of a reflective material to further enhance the lighting directed upward towards the product "P".

Information display portion 300 is configured to display product-related information thereon/therein. For instance, it is envisioned that information display portion 300 includes indicia thereon, and/or is configured to releasably accept a product information card therein (e.g., a translucent or transparent information card).

Additionally, while an angle α of information display portion 300 with respect to a base 310 of product display member 10 is shown as a particular angle, the angle α may be any reasonable angle, including an adjustable angle, to help maximize optimal viewing area. Base 310 may be parallel to shelf "S." For example, it is envisioned that angle α is between about 45° and about 90°, and may be equal to about 70°. It is also envisioned that the angle α is different on each vertically-spaced shelf "S." For instance, the angle α may be toward a lower end of the range (e.g., about 45°) when engaged with a shelf "S" that is positioned near the floor (e.g., a lower shelf "LS"), while the angle α may be toward a higher end of the range (e.g., about 90°) when engaged with a shelf "S" that is positioned closer to an average eye-level of a customer (e.g., a higher shelf "HS"). In such embodiments, the angles α of information display portion 300 with respect to base 310 of product display members 10 may gradually increase when engaged with lower shelf "LS" and when engaged with higher shelf "HS," for example.

The present disclosure also includes a product display member 10 having elongated portion 200 with light source 500 integrally formed therein; a product display member 10 having an elongated portion 200, lumen 210, and no attachment portion 100 (here, product display member 10 can be integrally formed with a shelf "S" or other product display device); and a product display member 10 lacking information display portion 300. Any combination of these features and other disclosed features are also contemplated.

Figure 3:
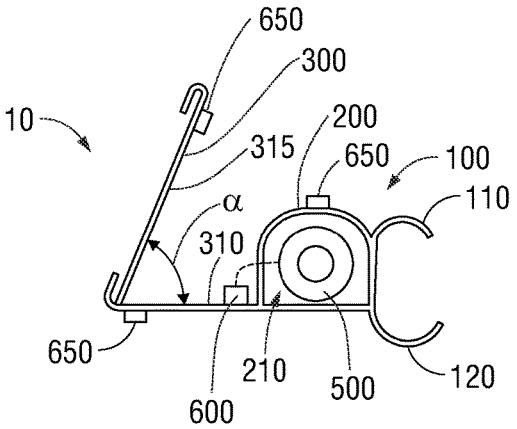
FIG. 3 is a cross-sectional view of the product display member of FIGS. 1 and 2.
Figure 4:
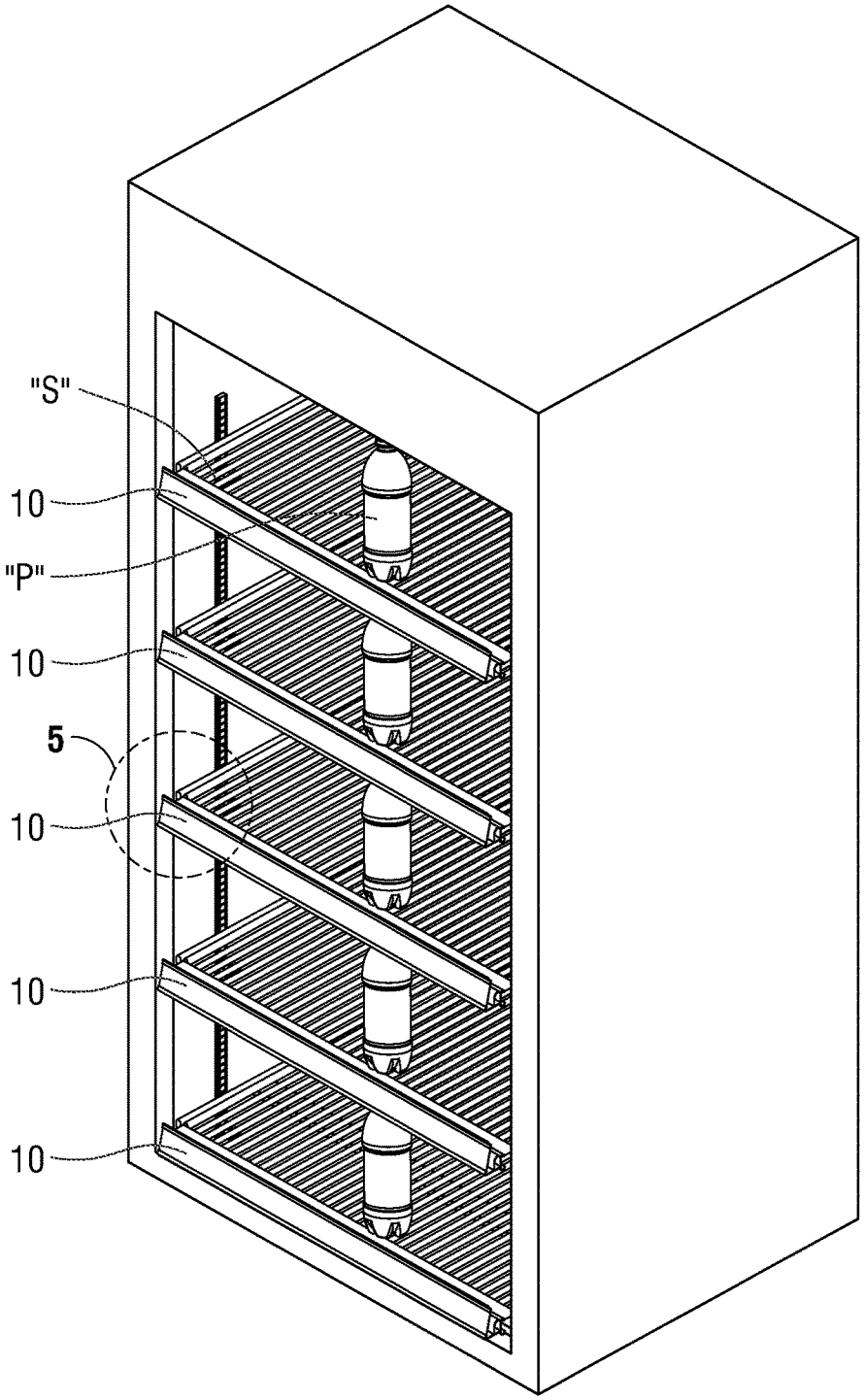
FIG. 4 is a perspective view of several product display members, each product display member shown engaged with a shelf of a refrigerated display and where each shelf includes a product thereon.
Figure 5:
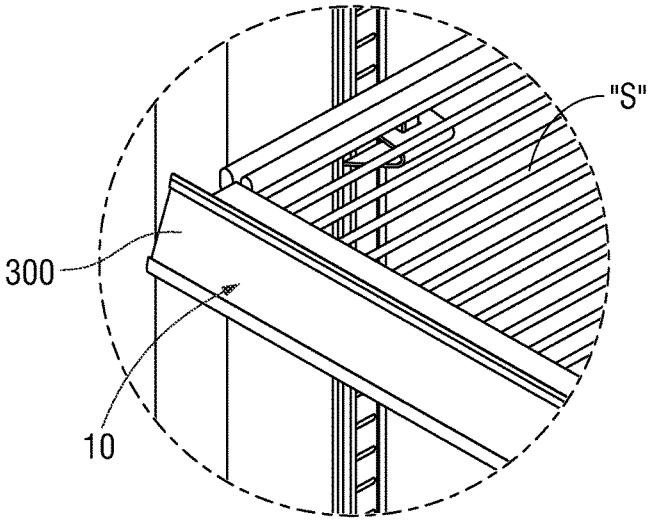
FIG. 5 is an enlarged view of the area of detail indicated in FIG. 4.

As shown in FIG. 3, at least one sensor 650 and an associated controller 600 may also be included on product display member 10. Sensor 650 may be positioned on any portion of the product display member 10, and may be either fixedly positioned or movably positioned thereon. It is envisioned that multiple sensors 650 may be used in cooperation with product display member 10. It is envisioned that sensor 650 (e.g., an infrared motion detector) is configured to detect if one or more products "P" are moved onto or removed from the associated shelf "S." The sensor 650 may also be positioned to detect whether a shopper is approaching the shelf "S." It is further envisioned that sensor 650 communicates (e.g., electrically communicates, wirelessly communicates, etc.) with light source 500 via controller 600 such that light source 500 can provide illumination based on what is detected by sensor 650.

Moreover, the present disclosure also includes adjusting (e.g., manually, automatically, via remote-control, etc.) aspects (e.g., color, intensity, duration, and/or power) of light source 500 based on various shopping parameters or conditions, and/or based on feedback from sensor(s) 650 including, for example, time of day, type of shoppers, presence of nearby shoppers, type of product being displayed of the associated shelf "S," amount of products being displayed on the associated shelf "S," location in store, height of product, health of product, etc. It is envisioned that at least one ultrasonic sensor 650 (e.g., with a separate controller 600) is used for such active monitoring of products "P," for example. It is further envisioned for light source 500 to include a plurality of independently controlled light sources 500. Ultrasonic sensor 650, in combination with a suitable controller 600, periodically emits high frequency sonic pulses away from display member 10 and towards a rear surface of a cabinet housing shelf "S". As the distance between the display member 10 and the rear surface is a fixed and known value, controller 600 is able to determine the elapsed time between the emitted sonic pulses and the return echo. The elapsed time is used to calculate the distance between the sensor 650 and the rear surface of the cabinet. If one or more products are positioned on the shelf "S" associated with the display member 10, then the calculated distance will be less than the known distance to the rear surface. In this instance, the controller 600 will recognize that one or more products are on the associated shelf "S". If all of the products are removed from the shelf "S" associated with the display member 10, then the calculated distance will be the same as the known distance to the rear surface. In this instance, the controller 600 will recognize that there are no products on the associated shelf "S".

Regardless of whether the sensor 650 is an ultrasonic sensor or an infrared sensor, the associated controller 600 is electrically coupled to the light source 500 for controlling the output of the light source 500. Further, the controller 600 may have an internal clock that may be used to control an output of the light source 500 depending on the time of day, day of the week, special holidays, etc.

For example, the combination of light 500 and/or sensor(s) 650 (e.g., at least one infrared motion detector) may be configured to illuminate products "P" on sale and/or the associated information display portion 300 in a particular color, to only illuminate products when a shopper is nearby, to illuminate the shelf "S" in the absence of products thereon (e.g., after shopping hours to notify clerks that products need to be restocked), to illuminate predetermined products (e.g., part of a particular diet) in a certain color (e.g., green), to flash light on product(s) when inventory is limited, to flash red light upon the rapid removal of several products on the shelf "S" (e.g., to deter theft), to illuminate products (e.g., with purple light) that are gluten-free, to illuminate products (e.g., with pink light) that pertain to a certain holiday or theme (e.g., Valentine's Day), etc. As can be appreciated, the uses of light(s) 500 and/or sensor(s) 650 are not limited to the examples above, as countless possibilities are envisioned.

The present disclosure also includes methods of displaying and/or illuminating products and/or product information using product display member 10 and/or light source 500. Methods include securing (e.g., removably securing) product display member 10 to a shelf "S," inserting light source 500 at least partially within lumen 210 of product display member 10, using light 500 to illuminate products "P" on shelf "S," using light source 500 to illuminate information display portion 300, etc.

While embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit of the claims appended hereto.

The invention claimed is:

1. A product display member, comprising:

an attachment portion configured to engage a portion of a shelf, the shelf defining a shelf axis extending between a distal portion of the shelf and a proximal portion of the shelf, the attachment portion including an upper portion and a lower portion, the upper portion defining an upper axis and the lower portion defining a lower axis, the upper axis and the lower axis being parallel to the shelf axis;

an elongated portion disposed in mechanical cooperation with the attachment portion, the elongated portion defining a lumen extending at least partially therethrough;

a light source disposed in mechanical cooperation with the lumen, at least a portion of the light source positioned between the upper axis and the lower axis, the light source positioned proximally of the attachment portion; and an information display portion disposed in mechanical cooperation with the elongated portion.

2. The product display member according to claim 1, wherein at least part of the elongated portion allows light emitted from the light source to pass therethrough.

3. The product display member according to claim 1, wherein at least part of the information display portion allows light emitted from the light source to pass therethrough.

4. The product display member according to claim 1, wherein a distal back surface of the information display portion allows light emitted from the light source to pass therethrough.

5. The product display member according to claim 1, wherein a base of the product display member defines an angle with respect to the information display portion, and wherein the angle is between about 45° and about 90°.

6. The product display member according to claim 1, wherein the lumen extends along an entire length of the elongated portion.

7. The product display member according to claim 1, wherein the light source is removably disposed within the lumen.

8. The product display member according to claim 1, wherein the attachment portion includes an upper arcuate portion and a lower arcuate portion.

9. The product display member according to claim 8, wherein the upper arcuate portion is configured to engage an upper wire of the shelf, and wherein the lower arcuate portion is configured to engage a lower wire of the shelf.

10. A method of displaying products, the method comprising:

engaging a product display member with a portion of a shelf, the shelf defining a shelf axis extending between a distal portion of the shelf and a proximal portion of the shelf, the product display member including:

an attachment portion configured to engage a portion of a shelf;

an elongated portion disposed in mechanical cooperation with the attachment portion, the elongated portion defining a lumen extending at least partially therethrough;

a light source disposed in mechanical cooperation with the lumen; and an information display portion disposed in mechanical cooperation with the elongated portion; and emitting light from the light source proximally along the shelf axis to illuminate the information display portion.

11. The method according to claim 10, further comprising adjusting an output of the light source based on a parameter detected by an associated sensor.

12. The method according to claim 10, further comprising automatically adjusting an output of the light source based on a time parameter from a controller.

13. The method according to claim 10, further comprising automatically adjusting an output of the light source in response to a sensor detecting an object in proximity to the product display member, the sensor and an associated controller located on the product display member.

14. The method according to claim 10, further comprising emitting light from the light source through the elongated portion.

15. The method according to claim 10, further comprising emitting light from the light source through the information display portion.

16. The method according to claim 10, further comprising emitting light from the light source through a distal back surface of the information display portion.

17. The method according to claim 10, wherein engaging a portion of the product display member with a portion of the shelf includes engaging an upper arcuate portion of the attachment portion with an upper wire of the shelf, and engaging a lower arcuate portion of the attachment portion with a lower wire of the shelf.

18. The method according to claim 10, further comprising adjusting an output of the light source based on an amount of products on the shelf detected by an associated sensor.

19. The method according to claim 10, wherein emitting light from the light source only occurs when there are no products on the shelf as detected by an associated sensor.

* * * * *